United States Patent [19]

Richardson

[11] Patent Number: 4,900,429

[45] Date of Patent: Feb. 13, 1990

[54] PROCESS UTILIZING PYROLYZATION AND GASIFICATION FOR THE SYNERGISTIC CO-PROCESSING OF A COMBINED FEEDSTOCK OF COAL AND HEAVY OIL TO PRODUCE A SYNTHETIC CRUDE OIL

[76] Inventor: Reginald D. Richardson, 57 Widdicombe Hill Blvd., Apt. 1504, Weston, Ontario M9A 1Y4, Canada

[21] Appl. No.: 873,925

[22] Filed: Jun. 13, 1986

[30] Foreign Application Priority Data

Jul. 29, 1985 [CA] Canada ..... 487723

[51] Int. Cl.[4] ..... C10G 1/00

[52] U.S. Cl. ..... 208/418; 208/419; 208/414

[58] Field of Search ..... 208/416, 408, 418, 419, 208/414, 411, 80, 434, 415

[56] References Cited

U.S. PATENT DOCUMENTS

| | | | |
|---|---|---|---|
| 2,987,465 | 6/1961 | Johanson | 208/415 |
| 3,247,092 | 4/1966 | Huntington | 208/408 |
| 3,565,784 | 2/1971 | Schlinger et al. | 208/408 |
| 3,652,446 | 3/1972 | Dengler et al. | 208/408 |
| 3,849,287 | 11/1974 | Gleim et al. | 208/434 X |
| 3,856,658 | 12/1974 | Wolk et al. | 208/434 X |
| 3,870,621 | 3/1975 | Arnold et al. | 208/415 |
| 3,929,615 | 12/1975 | Linden et al. | 208/408 |
| 4,001,105 | 1/1977 | Gifford, II | 208/408 |
| 4,111,786 | 9/1978 | Sugimura et al. | 208/415 |
| 4,324,640 | 4/1982 | Durai-Swamy | 208/416 X |
| 4,372,838 | 2/1983 | Kulik et al. | 208/416 |
| 4,376,695 | 3/1983 | Belinko et al. | 208/59 |
| 4,431,509 | 2/1984 | Tarman | 208/408 |
| 4,435,269 | 3/1984 | Gomory | 208/408 |
| 4,437,973 | 3/1984 | Huibers et al. | 208/418 X |
| 4,510,038 | 4/1985 | Kuehler | 208/434 X |
| 4,519,895 | 5/1985 | Deschamps et al. | 208/416 X |
| 4,541,916 | 9/1985 | Beutner et al. | 208/434 X |
| 4,578,175 | 3/1986 | Gorin | 208/416 X |

*Primary Examiner*—Glenn Caldarola

*Attorney, Agent, or Firm*—Rogers, Bereskin & Parr

[57] ABSTRACT

An energy integrated process for the production of a synthetic crude oil product from heavier oils and coal in which coal is pyrolyzed and a combined feedstock of coal, coal volatiles and a heavy oil product is co-processed to produce a synergistic yield of light crude oil compatible with the refining capabilities of existing conventional refineries.

37 Claims, 7 Drawing Sheets

PROCESS UTILIZING PYROLYZATION AND GASIFICATION FOR THE SYNERGISTIC CO-PROCESSING OF A COMBINED FEEDSTOCK OF COAL AND HEAVY OIL TO PRODUCE A SYNTHETIC CRUDE OIL

BACKGROUND OF THE INVENTION

Field of the Invention

This invention relates to a process for the production of a synthetic crude oil product, having a composition similar to that of natural crudes. From a feedstock of (1) heavy oil, tar sand bitumen or oil shale kerogens, or heavy residuals from these, (2) crushed coal, and (3) coal volatiles that have been pyrolyzed from coal, a blended synthetic crude oil product having benzenoid, paraffinic, napthenic and sulphur components in proportions similar to that found in natural crudes is produced.

The invented process is an integrated one in which crushed coal is thermally pyrolyzed to recover volatiles from the coal, and the coal volatiles, together with crushed coal and a heavy residual material produced, for example, by distillation of heavy oil, are combined and upgraded Preferably the upgraded product is then blended with light ends, for example, those produced by the distillation of heavy oil. The residual remaining after pyrolyzation of the coals and the residual remaining after upgrading are gasified to produce the thermal energy for pyrolyzation, upgrading and to facilitate hydrogen production for upgrading. The coal volatiles exiting the pyrolysis stage are condensed from the hot synthesis gas (syngas) and the syngas once stripped of the coal volatiles is then utilized to produce thermal energy to in turn produce other forms of energy required for the processing and upgrading of the coal—coal volatile—heavy residual mixture. Depending upon the proportions of any constituent in the coal—coal volatile—heavy residual feedstock, the amounts of thermal energy used for any particular energy production can be altered. The process is one incorporating a high degree of integration of the units of the process and of energy production and use, and results in a system which once initiated can be essentially energy self-sufficient in that substantially all of the energy required for processing and upgrading can be economically provided from low value hydrocarbon residuals produced in the process. In addition, energy production within the process can be adjusted to effectively co-process electricity as a significant by-product.

The invention also relates to a pyrolyzation apparatus for pyrolyzing coal to produce coal volatiles in which crushed coal is systematically passed countercurrent to a hot syngas in a vertical tower.

By the utilization of a coal-oil feedstock mixture of preferred proportions, a synthetic light crude oil can be produced comparable to natural light crudes and compatible with the refining capabilities of existing conventional refineries.

The world's higher quality light natural crude oils are those having an API of 35° to 45° with a sulphur content less than 0.5 percent. These high quality light natural crudes cost the least to refine into a variety of highest value end products including petrochemicals and therefore command a price premium. More important, however, world refinery capacity is geared to a high proportion of light natural crude oils with an API of about 38° or higher.

It is generally accepted that world supplies of light crude oils recoverable by the conventional means of drilling wells into reservoirs and the use of nature's pressure, or by pumping to recover the oil, will be diminished to the extent that in the coming decades these supplies will no longer be capable of meeting the world demand.

To find relief from oil supply shortage it will be necessary to substantially increase processing the vast world reserves of coal and viscous oil, bitumens in tar sands and kerogens in oil shale. This source of crude oil remains largely unexploited today although recovery of oil from tar sands is in practice in Canada. In Canadian Pat. No. 1,065,780 I have described an integrated process for the recovery of oil and bitumen from less conventional sources of oil and the upgrading thereof. Canadian Pat. No. 1,065,780, deals with the recovery of oil and bitumen from heavy oil deposits, from tar sands, from shale or from the liquefication of coals and the upgrading of this oil or bitumen in an integrated recovery and upgrading process.

The development of technology for the production of synthetic oil as an alternative to the light crude oil found in nature continues to be plagued by the large capital investments required in recovery and production facilities and a long wait for return on investment. In addition, large expenditures are required to retrofit refineries for synthetic oils recovered from heavy oils and bitumens. In addition, present synthetic oil plants for processing heavy oils, or bitumens from tar sands, have focused more on the development of systems for recovery and production than on energy efficiency, maximization of yield and high environmental processing standards. Except for South Africa's Sasol process, which benefits from low cost labour used in coal mining, straight coal liquefication is not yet cost competitive with synthetic oil produced from tar sands bitumen or heavy oils.

It is of considerable importance that ways are found to produce light synthetic crudes comparable in quality to the rapidly depleting reserves of light natural crudes available from conventional sources and at a cost at least approaching these crudes and fully competitive with the crudes being recovered at higher cost from under the sea or from frontier areas such as the extreme north with its rigorous climate. It is also important that light synthetic crudes are comprised in desired proportions of a mixture of benzenoid, naphthenic and paraffinic components as these three families of compounds comprise essential feedstck to refinery capacity producing today's transportation fuels and feedstocks for the petrochemical industry.

The invented process is designed to enable the economic production of synthetic crude oil having characteristics comparable to the world's best light natural crudes, i.e. an API of 40° or higher, a sulphur content of less than 0.5 percent and balanced proportions of benzenoid, napthenic and paraffinic compounds suitably matched to general refinery market demand and capacity. In the invented process, it has been found that coal which is the most abundant of all fossil hydrocarbons can play a key role in achieving this objective. The benzenoid content of the coal is a factor to the benzenoid content of the final product and contributes synergistically to the hydrogen upgrading.

With the advent of improved methods of recovering heavy viscous oil and tar sands bitumens by in situ methods from many smaller deposits, the development of communal recovery and upgrading systems based on gathering and pipelining relatively small amounts of heavy oil materials to central refineries for synthetic oil production, is strongly indicated. Since large quantities of coal are used in the invented process and large reserves of strip mineable coal are to be found throughout the world it is anticipated that most synthetic oil refineries might very well be sited at the source of coal with heavy oils and/or bitumens being gathered and pipelined to coal. However, raw material supply logistics may dictate that coal would move to synthetic oil refineries located at the sites of large reserves of heavy oil or tar sands bitumens, in some cases. Pipeline systems may evolve in which coal slurries are moved to sites of heavy oil or bitumen recovery solely as fuel for required energy for recovery with the recovered heavy oil or bitumen being then pipelined for upgrading to synthetic oil in refineries at the source of coal in the same overall pipeline system. The location of synthetic oil refineries at the site of large coal reserves in lower temperature climates in central southwestern Canada to avoid the cost penalties of more rigorous northern climates is of considerable interest to the invented process.

In the invented process, a preferred feedstock for hydrogen upgrading marries coal, and the volatiles from coal, with heavy oil or heavy oil bottoms remaining after initial distillation of heavy oil and upgrades that feedstock to provide a base material for producing a light synthetic crude well matched with natural crude oils on which refinery production and capacity has been based in the past. The invented process not only exploits the lower cost of coal as a basic feedstock constituent, but exploits a chemical synergy promoted by the coal constituent during hydrogen addition upgrading which promotes a high yield conversion of the coal—coal volatile—heavy oil feedstock to a higher quality light synthetic crude than may be produced from either feedstock constituent separately and at less severe operating conditions than those that would be required to upgrade either separately. The heavy oil constituent is product derived from a non-coal source. Molecular theory indicates that the highly reactive hydrogen double-bonded benzene ring molecules in the coal volatiles and crushed coal enhances recovery rates in the upgrading of the mixed feedstock. Accordingly, not only is oil recovered from coal by two means and from heavy oil, with residuals being used for energy generation, but the use of coal volatiles and crushed coal in the feedstock creates a synergistic effect on the recovery rate.

By then mixing the upgraded lighter crude oil recovered from upgrading the coal—coal volatile—heavy oil feedstock with light ends obtained from other heavy oil dedicated upgrading processes, such as distillation, a blended synthetic light crude product can be produced which has viscosity properties and benzenoid, paraffinic, napthenic and sulphur proportions comparable to that found in the better natural light crude oils.

Canadian Pat. No. 1,065,780 deals briefly with an alternative for upgrading heavy oil wherein crushed coal or shale is mixed with recovered heavy oil as the hydrocarbon feedstock to an upgrading process. This relates solely to a liquefication of oil from coal or shale, without utilizing coal and pyrolyzed coal volatiles in a proportion that would produce the chemical synergy of the present invention to significantly enhance yield and produce a base synthetic crude oil that can be used to give a synthetic crude oil compatible with present light crude oils. In addition, various levels of technology have been developed in the past for the distillation or liquefication of coal and the hydrogenation of the condensible coal volatiles (U.S. Pat. No. 3,107,985 to Huntington) and to the pyrolysis of coal and recovery of the volatile hydrocarbons (U.S. Pat. Nos. 4,085,030; 4,102,773; and 4,145,274 to Green; 2,634,286 to Elliot; 3,988,237 to Davis; and 4,229,185 to Sass). However, these are each dedicated to coal as a single source of refineable oil whereas the present invention utilizes coal and pyrolyzed coal volatiles together with heavy oil in selected proportions to produce enhanced yields of refinable (lighter) oil and to lead to the production of a lighter crude oil similar to those obtained from natural deposits.

Accordingly, a process is provided for the production of a synthetic crude oil from heavy residual non-coal material and coal in which crushed coal is thermally pyrolyzed to produce coal volatiles. The coal volatiles are condensed out and mixed with crushed coal and a heavy residual of heavy oil, tar sands bitumen or oil shale kerogens to produce a coal—coal volatile—heavy residual feedstock which is upgraded in a synergistic production of a light crude oil. The lighter crude produced can then be further mixed with light ends obtained, for example, from the distillation of heavy oil, tar sands bitumen or oil shale kerogens to produce a blended synthetic-like crude oil with a composition similar to that of natural-like crudes, a result not achieved at present by conventional independent processing of coal or heavy oils. In addition, an improved pyrolyzation apparatus for achieving the pyrolyzation of coal in the process is provided for.

In the process, the upgrader can comprise high level hydrogen additional upgrading, or alternatively, an upgrading process arrangement may be utilized whereby the hydrogen additional upgrading reactor is operated at lower severity, i.e. reduced temperature, pressure, hydrogen or catalyst consumption and/or reduced feed stock residence time, thereby providing for a lower rate of conversion of the three part feedstock mix to light oil product than is possible by higher severity operations. An increase in heavy residual materials will be produced by such lower severity hydrogen addition upgrading. The upgrading residual material is then thermally cracked into a light oil fraction and coke residuals, with a final blended light synthetic oil product comprising, for example, the light ends of the distillation of heavy liquid oil, the light products of hydrogen addition upgrading of the three part feedstock mix and the light product produced by hydrocracking the residuals from the hydrogen addition upgrading step.

After either of these upgrading methods, the combustible char residual from the coal pyrolysis step and the heavy residuals or coking residuals produced in the upgrading, as the case may be, are gasified to provide the energy for process use, including thermal energy for pyrolysis and upgrading, and as a means to hydrogen production. Alternatively, or additionally, low volatile content coal can be used as gasifier feed.

By adjustments in the proportions of each component in the three part feedstock mixture, variations may be made in the product characteristics to meet specific requirements of refineries producing different end products.

Energy is produced in-process from waste residuals of the process. The integration of processing with several systems for energy generation and production enables the process to be adjusted or tuned to different production requirements or energy requirements in different parts of the process, or to produce energy, such as electricity, as a by-product.

In addition, the process is also environmentally advantageous in that injurious emissions to atmosphere are avoided and solid wastes are minimized and readily disposed of. Where the process is located at or near the source of coal, waste materials will occupy a small fraction of coal mined-out space.

These and other features of the present invention will be more readily apparent from the following description with reference to the accompanying drawings.

THE OVERALL PROCESS SYSTEM

Figure 1:
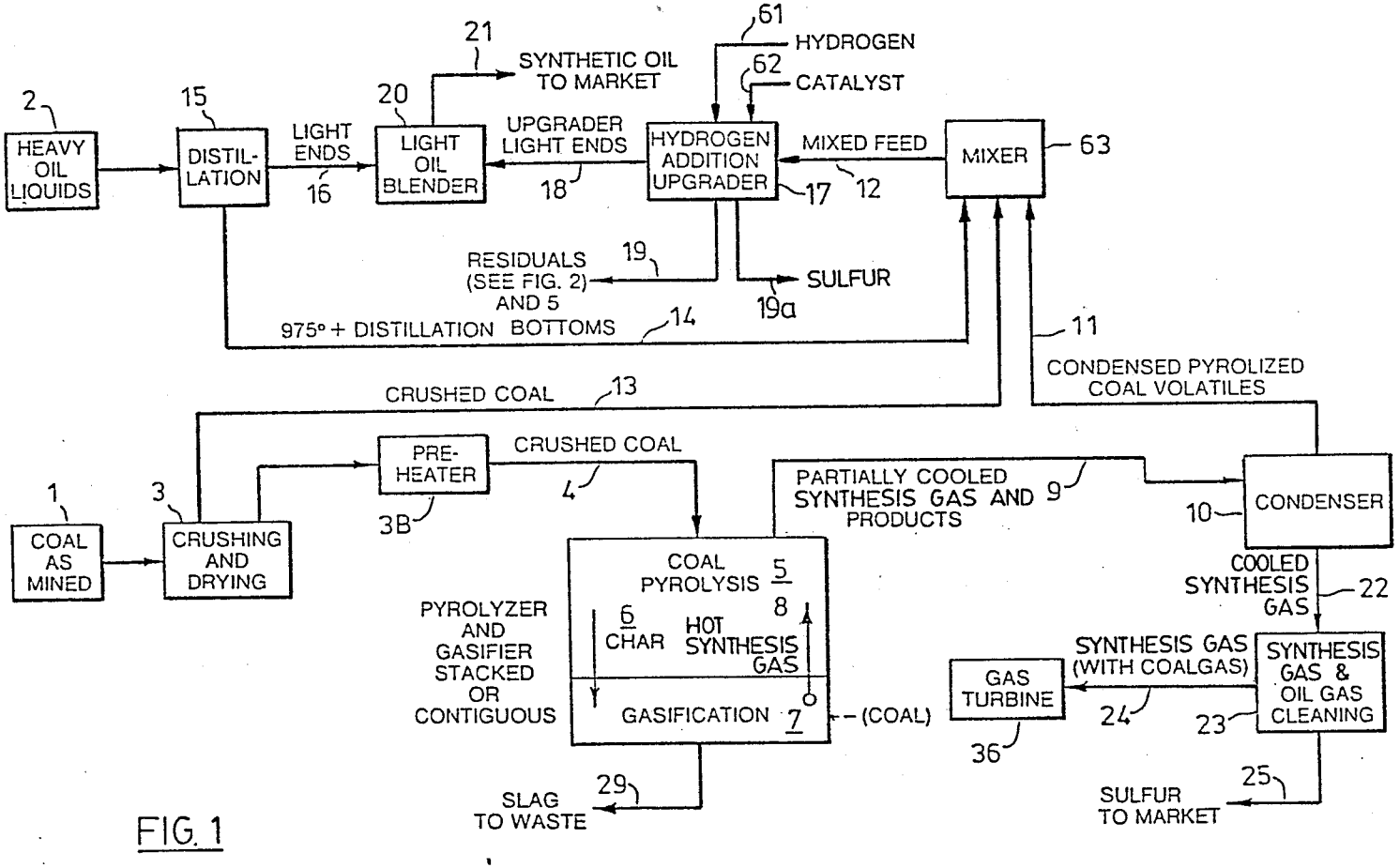
FIG. 1 is a simplified schematic flow diagram illustrating the processing steps of the present invention as applied to the production of a light synthetic crude oil from a mixed raw material feedstock of coal, coal volatiles and heavy oil liquids.

In accordance with the present invention, there is provided a process for concurrently converting coal 1 and heavy viscous oil liquids 2 to a light synthetic crude oil comparable in quality, viscosity and range of constituents to naturally occurring light crudes.

The coals 1 can take the form of bituminous subbituminous or anthracitic material or a mixture of these. The heavy oil liquids 2 being derived from non-coal sources, may be comprised of the heavy residuals of heavy oil refining, raw heavy oils recovered by enhanced recovery means, tar sands bitumens recovered such as by surface mining, sand tar separation or in situ recovery, oil shale kerogens or mixtures of one or more of these heavy oil liquids.

The coal, as mined, is crushed to two particulate sizes, both sizes being dried 3 at the surface of the particles completely and to an absorbed moisture content of between 5 and 15 percent. The larger particle size coal 4 is preferably less than 1,000 microns in size, and is fed at a temperature preferably in the range of 300° F. to 400° F. reached by the drying and additional preheating, if necessary, to the top of the pyrolyzer 5. This coal 4 is further heated as it descends through the pyrolyzer 5 to a pyrolysis temperature in the range of 850° F. at which temperature the volatiles in the coals are vapourized and largely stripped from the coal to leave a char residue 6. The char residue with minimum loss of temperature is fed to a gasifier 7 where it is combusted by partial oxidization to produce a hot synthesis gas (syngas 8). The hot syngas 8 exiting the gasifier 7 flows upward through the pyrolyzer 5 countercurrent to the descending coal 4, with a substantial part of the sensible heat of the hot syngas being given up to the coal both by direct contact and indirectly through the heating of the pyrolyzer inner apparatus and contact of the coal with the pyrolyzer inner apparatus (as will be further described later), thereby stripping the coal of its volatiles by pyrolysis and producing the char 6 to be used, inter alia, as fuel for hot syngas production. The vapourized coal volatiles 9 flow with the now partially cooled syngas to a condenser 10 for extraction of a stream of condensed pyrolyzed coal volatiles 11 which are fed to a feedstock mixer 63 becoming one of the three components of the hydrogen addition feedstock 12. Carry over of non-condensible coal volatiles combine with gasifier syngas to increase the BTU value of this gas stream.

The second particulate size coal 13 is preferably less than 200 microns in size and is fed at a temperature preferably in the range of 200° F. to 300° F. reached in drying, and additional preheating if necessary, to the feedstock mixer 63 as the second of the three components of the mixed feedstock.

The embodiment illustrated in FIG. 1 illustrates the utilization of heavy bottoms 14 as the third component of the hydrogen addition feedstock. The heavy bottoms are illustrated as produced by fractionating through distillation 15 an unprocessed heavy oil liquid feed 2 to produce light ends 16 and the heavy bottoms 14, the latter characteristically having a boiling point greater than 975°.

The three feedstock 12 components, the crushed coal of a particulate size in the range of 200 microns 13, condensed pyrolyzed coal volatiles 11 and heavy oil bottoms 14 are slurried in the mixer 12 and fed to the hydrogen addition upgrader 17 together with hydrogen 61 and catalyst 62. Preheating or prehydrogenation of the feedstock or of any one or more of the three feedstock components may be desirable as part of the mixing step of this feedstock to increase their blending capability or hydrogen content. The feedstock 12 is hydrogenated and hydrocracked in the upgrader 17 to produce a light product 18 which can then be fed for final blending with the light ends 16 produced by distillation 15 of the heavy oil liquids 2. This blended product forms a light synthetic crude oil 21 comparable to natural light crudes and ready for traditional refining in conventional equipment. Sulphur is also removed and preferably recovered during upgrading.

Within this process, the coal char 6 from pyrolyzation and the residuals 19 from upgrading are utilized for energy production.

The cooled syngas 22, after pyrolyzed coal volatiles have been condensed in condenser 10, proceeds to a scrubber 23 to remove $H_2S$ from which in turn elementary sulphur 25 can be produced for market. The cleaned syngas 24 is then used to generate steam for the production of heat for upgrading and to drive turbines to produce electricity for hydrogen and oxygen production by electrolysis 28, the hydrogen being used in upgrading 17 and the oxygen in gasifiers 7 and gasifiers 26 to be described below.

Figure 5:
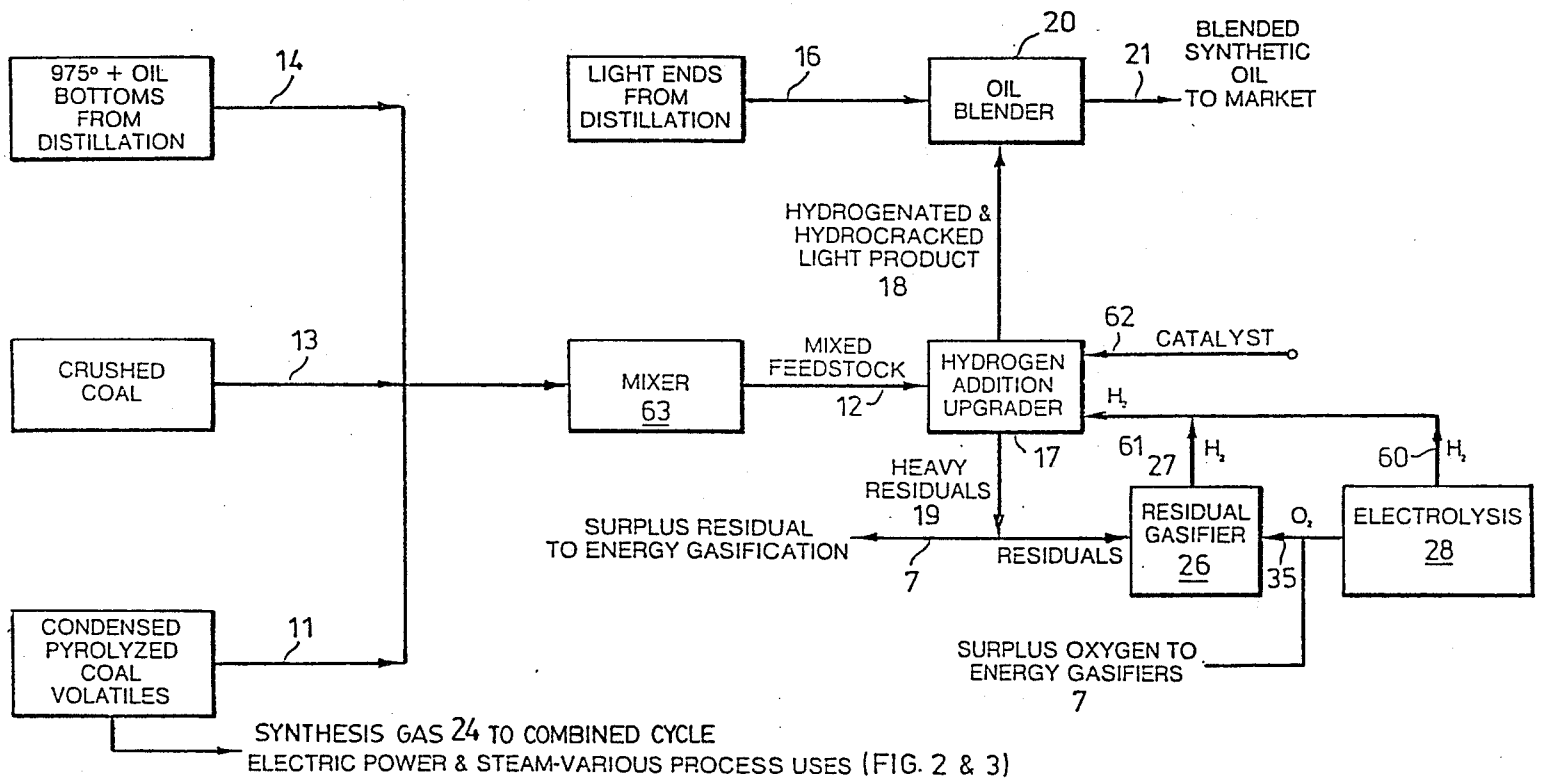
FIG. 5 is a simplified schematic flow diagram illustrating the hydrogen addition upgrading of feedstock and production of a final blended light synthetic crude oil product in the process of FIG. 1.

As illustrated in FIG. 5, the residuals 19 from upgrading are utilized as feed to the gasifiers 7 to combine with coal char for syngas production for use in pyrolysis and subsequent energy production and/or for gasification in gasifiers 26 to produce a hydrogen rich gasifier gas from which hydrogen can be water quenched to produce additional hydrogen 27 for upgrading. The use of the heavy residual 19 can be gasifiers 7 and gasifiers 26 to achieve the desired amount of coal volatile and at the same time produce sufficient hydrogen for upgrading through a combination of electrolysis produced hydrogen 60 and hydrogen 27 recovered from gases produced in gasifiers 26.

COAL PYROLYSIS AND CHAR GASIFICATION

Figure 2:
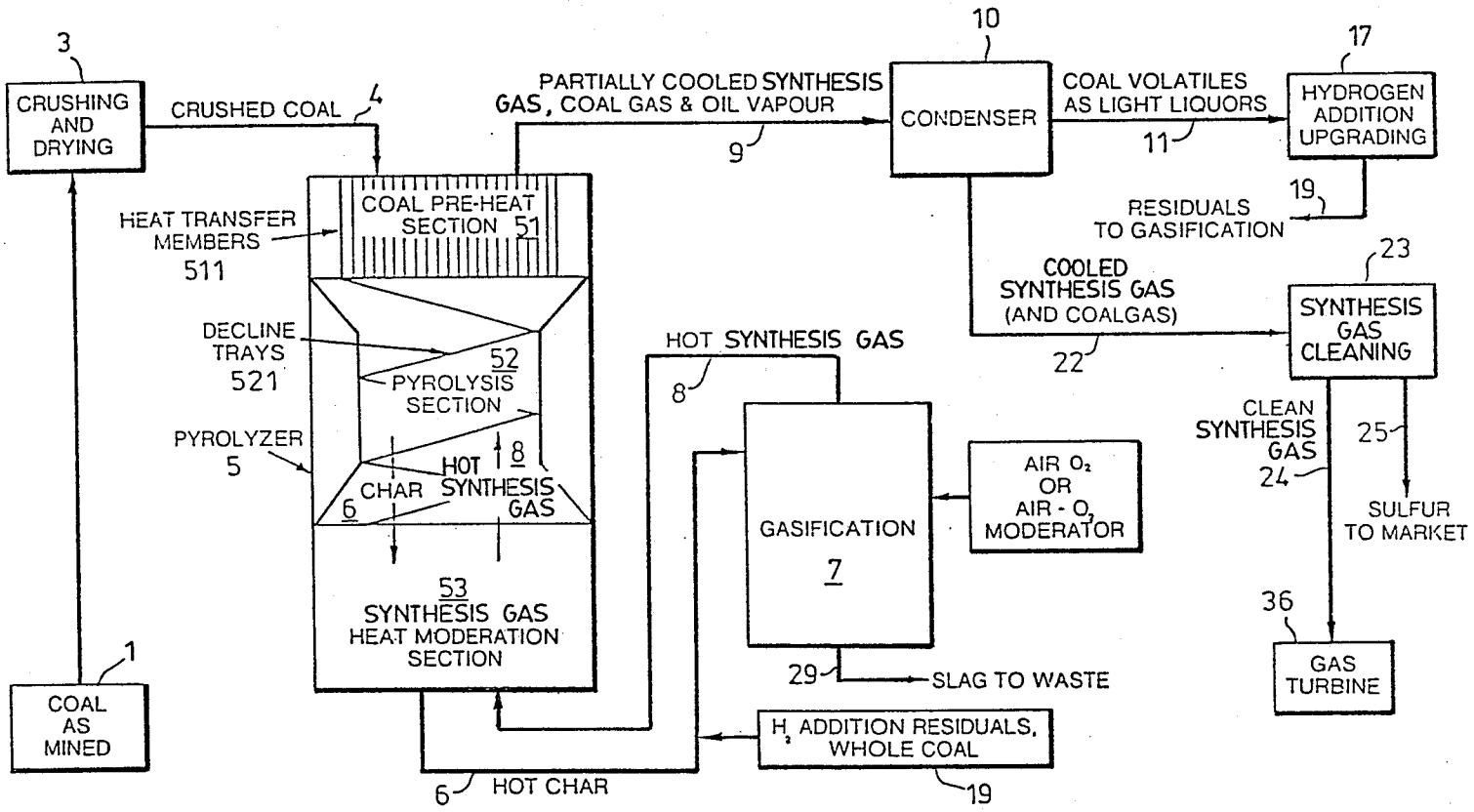
FIG. 2 is a simplified schematic flow diagram of the coal pyrolysis and gasification steps for the production of coal volatiles in the process of FIG. 1.

FIG. 2 further illustrates the coal pyrolysis 5 and char gasification 7 process steps. As described, the coal is fed to a crushing and drying apparatus 3 and comminuted to a particle size of less than 1,000 microns for pyrolysis use and heated until dry at the surface and to an absorbed moisture content of between 5 and 15 percent, as described above. This crushed coal 4 may be additionally heated beyond the required drying temperature to attain a temperature of 300° F. to 400° F. prior to pyrolysis in a preheater 3B or in a preheat section 51 of a pyrolysis tower 5. Preferably, a pyrolysis tower will comprise a vertical tower or vessel stacked directly on, or contiguous to, a partial oxidation gasifier 7. With the stacked or contiguous arrangement for the pyrolyzer 5 and gasifier 7, the shortest and most direct transfer of hot gas to the pyrolyzer, and of the char 6 produced in the pyrolyzer to the gasifier, is accomplished.

The pyrolyzer 5, as will be further discussed below, is fitted throughout the length of preheat section 51 and a central pyrolysis section 52 with different means to direct a downward semi-turbulent fall of the particulate coal 4 and the upward countercurrent flow of hot syngas, with the gradual heating of the coal 4 from its feed temperature at the top to a pyrolysis temperature to about 850° F. toward the bottom of the pyrolysis section 52. The hot syngas flowing upward from the bottom of the pyrolyzer 5 will give up a substantial proportion of its sensible heat as it travels up the pyrolyzer creating a reducing temperature profile from bottom to top. At the point of transfer from the gasifier 7 to the pyrolyzer 5, the hot syngas is preferably in the temperature range of 2,000° F. to 2,400° F., with the temperature at the bottom of pyrolysis section 52 being preferably in the range of 850° F. and decreasing from there upwards Heat transferred to the descending coal 4 and to the pyrolyzer apparatus in pyrolysis section 52 will create the preferred temperature profile with the temperature of the partially cooled syngas and oil vapour stream 9 at the exit of the pyrolyzer preferably being in the range of 400° F. to 600° F.

The hot gasifier syngas 8 is the heat supply source and heat carrier for pyrolysis. It is also the gas which carries the pyrolyzed coal volatile vapours out of the pyrolyzer 5 for condensation 10 and recovery in liquid form 11.

It is preferred that the temperature of the pyrolyzer apparatus 5 in its preheat section 51 or of the crushed coal feed 4 entering the preheat section 51, does not drop below that at which condensation of the oil vapours in the syngas will take place in that section 51. Also, heat moderation of the high temperature syngas exiting the gasifier 7 and entering the pyrolyzer 5 to somewhere in the range of 1200° F. to 1700° F. may be necessary in a heat moderation and heat recovery section 53 to maintain the preferred temperature profile in the pyrolyzer 5 and avoid a rise in coal temperature beyond the point at which pyrolysis takes place to a level where products of thermal degradation are produced. Various cooling means may be used in pyrolyzer section 53 to extract heat from the syngas sufficiently to avoid thermal degradation. Partial cooling by heat exchange with heat recovery for process use may be used or some partially cooled and oil vapour stripped syngas 22 may be recycled to the bottom section of the pyrolyzer 5. Heat moderation of the syngas 8 in the bottom section 53 of the pyrolyzer will also prevent the coal char residue 6 of pyrolysis from agglomerating and reaching a tacky state where it may adhere to the inners or walls of the pyrolyzer 5.

As an optional means to increase heat transferred in the pyrolyzer, non-combustible objects of a size substantially greater than that of the coal particles 4 can be added to the crushed coal feed to the pyrolyzer. Multisided ball-like shapes comprising metals, ceramics, or other material not subject to heat decomposition or fracturing by collisions with coal particles or the pyrolyzer apparatus, and of a size preferably in the range of 4 to 8 times the diameter of the crushed coal particles, can be added to the crushed coal feed 4. These non-combustible objects would preferably be heated in the pyrolyzer to a temperature in the neighbourhood of 1,200° F. This is preferred as a maximum temperature. These heat transfer objects would be screened out of the coal char 6 proceeding to the gasifier 7 and continuously recycled at high temperature to the top of the pyrolyzer 5 to be mixed with new incoming crushed coal 4 and thereby continuously operate as an additional heat transferring vehicle during the time the coal is in the pyrolyzer.

A preferred pyrolyzer 5 will promote a high level of turbulent and collisive activity in the descending coal stream 4. Because of physical interactions of the descending heat transfer objects with the lighter and smaller coal particles, additional turbulence of the descending coal stream would occur through additional deflections and collisions. Beneficial interference with coal agglomerations and scouring of the pyrolyzer apparatus will also result from using such heat transfer objects.

The heat transfer objects could also take the form of large oil shale particles added to the crushed coal feed 4. Such oil shale particles would themselves be stripped of kerogens in the pyrolyzer 5 to provide some additional oil volatile, with the residual particle being separated and recycled to the pyrolyzer feed as described previously.

The gasification of hot coal char residues . 6, alone or mixed with residuals 19 from hydrogen addition upgrading 17, is carried out in an air, or oxygen enriched air, or oxygen moderated gasifier 7. Gasifier slag 29 will proceed to waste. Alternatively, or additionally, to these oil residuals 19, whole coal may be used to supplement the char residual feed to gasifiers 7. A variety of coals including anthracites with low volatile content, if available at cost, comparable to the higher volatile coal feed to pyrolysis, would make suitable gasifier fuel supplements.

The hot syngas 8 produced by the gasifier will proceed through the pyrolyzer 5 performing its functions of pyrolysis and oil vapour transport out of the pyrolyzer as discussed above. As discussed above, after condensation and extraction of oil volatiles, the cooled syngas 22 is cleaned to remove $H_2S$ and other impurities, and utilized to produce electric power and steam for process requirements by the use of combined cycles comprising gas turbines and steam turbines or alternatively gas turbines together with waste heat boilers and back pressure steam turbines as will be described hereafter in reference to FIG. 3.

One embodiment of the internal apparatus of the pyrolyzer as illustrated in FIG. 2 consists of two principal sections, a preheat section 51 and a pyrolysis section 52. A heat moderating section 53 may also be desirable. The preheat section consists of a number of horizontal gratelike crisscrossed members 511 spaced apart throughout a substantial proportion of an upper preheat section 51 of the pyrolyzer tower 5. All of these members will be heated by the upward flowing hot syngas. Each succeeding lower set of members will be offset from the one above in a manner designed to increase the contact of the falling coal with the hot members and to create, by deflecting the coal and impeding its fall, a semi-turbulent flow in which a substantial proportion of the coal particles strike the apparatus and one another and are also more and longer exposed to direct contact with the ascending syngas. The horizontal grate-like members 511 of the preheat section 51 will be spaced sufficiently apart, and of a shape to avoid agglomerations or accumulations of coal particles on them but sufficiently close together to enable heat transfer from the hot syngas to permit an increase in temperature from the top to the bottom of the section to the level of 500° F. to 600° F.

Heating to the temperature at which coal pyrolysis takes place of 850° F. occurs in the pyrolysis section 52 of the pyrolyzer tower 5 in which chute-like declined tray 521 are arranged in alternating flow directions throughout the section. The tray chute arrangement provides for the descending coal to flow back and forth from one tray chute to the next tray chute lower. The tray chutes 521 are heated to a progressively higher temperature from top to bottom as the hot syngas is gradually cooled as it proceeds up the tower against the bottom of the inclined trays and countercurrent to the coal flowing downward across the trays, the coal being gradually increased in temperature. The declined chutes or trays 521 which might be appropriately termed tray chutes act principally as heat transfer surfaces. However, they perform other functions. The angle of decline of the tray chutes and the spacing between them are factors in increasing the turbulence of the coal flow thereby increasing the heat transfer effectiveness. They also control the time taken for coal to pass through the pyrolyzer. Sufficient surface area of tray chutes is provided to raise the temperature of the descending coal from 500° F. to 600° F. at the top of the section 52 to the pyrolysis temperature of about 850° F. at the bottom of the pyrolysis section 52. It is important to note that the descending coal approaches and then reaches the pyrolysis temperature of about 850° F. only as it flows down the last few tray chutes and that the residence time of the coal on any of these chutes will be measured in seconds.

In this embodiment, heat transfer from the hot syngas to the coal is achieved by four principal means: (1) The direct contact of the counter current flows of coal with hot syngas. (2) The direct contact of the coal with the heated tray chute surfaces and other members of the pyrolyzer apparatus. (3) The exchange of heat between coal particles mixing as they fall with some turbulence across the trays and in particular at points where the coal falls from tray to tray. (4) Finally a general profile of temperature exists in the tower 5 which is highest at the bottom close to the entry of the syngas where it is at the highest temperature and gradually reducing up through the tower. This temperature profile assists in achieving a controlled heat transfer which educes a higher percentage of the coal volatiles while producing residual char. An efficient residence time for each coal particle on the highest temperature tray chutes in the pyrolyzer is estimated at less than 1 minute. However, the residence time may be increased or reduced by increasing or reducing the size of the apparatus and/or modifying the degree of decline in tray chutes.

The pyrolyzer is preferably insulated to minimize heat loss and constructed of material designed to withstand the high internal temperatures and the friction of hot coal particles and other heat transfer objects passing down through the pyrolyzer.

It will be understood that the pyrolyzer apparatus described above may be considerably modified as required to meet objectives for heat transfer efficiency. The residence time of the coal feedstock may be increased or decreased by increasing or decreasing the overall size of the tower (height or diameter), the number, spacing and area of heat transfer surfaces, the angle of decline of tray chutes, the rate of coal feed and the use of heat transfer objects such as the ceramic shapes or slate particles described above. The degree of turbulence of the descending coal will be affected by such modifications, heat transfer efficiency benefitting from turbulent mixing. The pyrolyzer may also be operated at a wide range of pressures below 500 to 600 PSI, the approximate pressure at which the gasifier is expected to operate.

The pyrolysis of coal in the process described allows for the production of a coal volatile component 11 for the feedstock having a high benzenoidal content which is highly beneficial as an active agent in improving the conversion of heavy hydrocarbons to light crude oil by hydrogen addition upgrading. At the same time, the production of syngas 8 is achieved by the use of coal char 6 or upgrading residuals 19 which are essentially waste fuels having had their highest value components stripped out for use in a final product.

All of the heat energy and electric power required for process use is produced by converting pyrolyzed coal char 6 or hydrogen addition waste residuals 19 to gasifier syngas which will be used to produce the process energy required in its various forms and also the hydrogen and oxygen needed.

Figure 3:
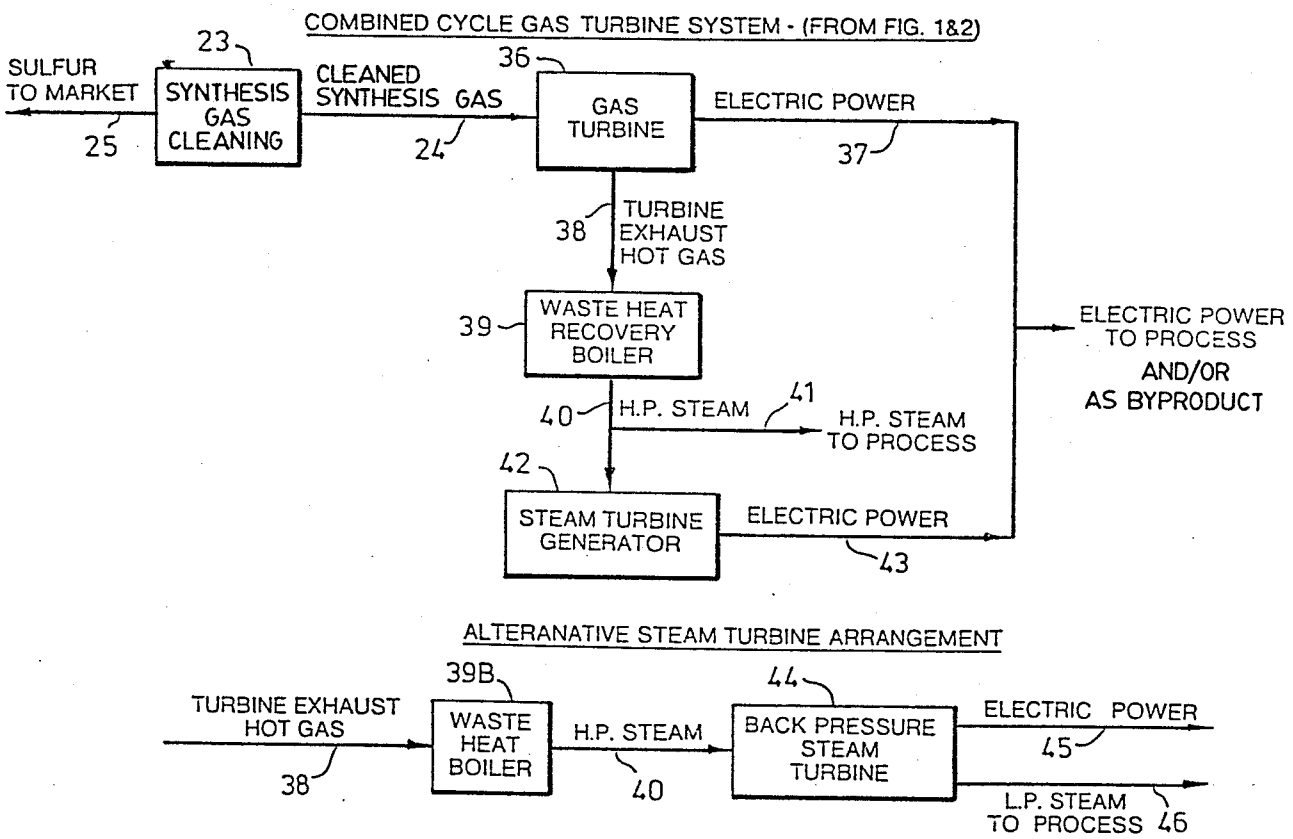
FIG. 3 is a simplified schematic flow diagram illustrating the production of energy for process use in a combined cycle system.

As shown in FIG. 3 the syngas produced by char and residual gasification, after contributing much of its sensible heat to coal pyrolysis and a portion of the remaining sensible heat as may be recovered economically for various other process uses and after being stripped of pyrolyzed coal volatiles by condensation, and $H_2S$ gas and other impurities removed, but still carrying with it some non-condensible coal gases of higher BTU value, is used so enriched as combustion gas 24 in gas turbines 36 for the production of a substantial proportion of the electric power 37 required for the overall process operation. The remaining electric power 43, also a substantial proportion of the total required, will be produced by means of a steam turbine 42 driven by high pressure high temperature steam 40 generated in a waste heat recovery boiler 39 using the hot exhaust gases 38 of the gas turbine 36.

A portion of the steam generated as above will be used directly as process heat 41, instead of being converted to electric power, by a diversion of part of the high pressure high temperature steam generated in the waste heat recovery boiler 39. Alternatively, to provide the highest possible combined cycle energy efficiency, where lower pressure, lower temperature steam satisfies other process heat requirements, all of the steam generated in the waste heat boiler 39 from the hot turbine exhaust gases 38 may be used to drive a back pressure steam turbine 44 enabling the production of electric power 45 and a large volume of low pressure steam 46. In a larger plant both kinds of combined cycle systems may be advantageously used.

HYDROGEN ADDITION UPGRADING AND HYDROGEN PRODUCTION

FIG. 5 illustrates the process steps relating to hydrogen addition and hydrogen production for hydrogenating and hydrocracking the three part feedstock. The mixed three part feedstock 12 is fed to the hydrogen addition upgrader 17. The pyrolyzed coal volatile and crushed coal preferably represent 40 to 70 percent of the feedstock 12, with the coal volatile representing preferably 15 to 27 percent by weight.

Various conventional hydrogenation and hydrocracking process arrangements may be used, as known by those skilled in the art, such as fixed bed, ebulating bed and other known process methods used to achieve improved hydrogenation and hydrocracking efficiency. The selection of the most suitable upgrading unit is deemed to be within the scope of those skilled in the art. The selection will be influenced by the composition of the feedstock and the desired yield. The choice of a catalyst for use in the hydrogen addition upgrading is also deemed to be within the scope of those skilled in the art. As will be apparent to one skilled, the choice of a catalyst will vary according to the composition of the feedstock and the proportions of each of the three components in the feedstock in order to achieve optimum catalytic efficiency. Catalysts such as cobalt molybdate provide a base from which to make optimizations for particular feedstock mixes.

In hydrogen addition reactions, the double-bonded benzene ring, which is a major molecular component of coal volatiles, increases the hydrogenation and hydrocracking thereby increasing conversion at lower levels of reactor severity, shorter residence time and with reductions in hydrogen and catalyst consumption.

Preferably, the process steps for the inprocess production of hydrogen for hydrogenation and hydrocracking in the hydrogen addition upgrading step 17 is closely integrated with the hydrogen addition step itself and with energy requirements throughout the process. As indicated, the hydrogen required for hydrogen addition upgrading 17 is derived from two source. A substantial portion is produced by an oxygen blown gasifier water quenched system 26 fueled by residuals 19 from the upgrader 17. The remaining hydrogen is produced by the electrolysis of water 28. The co-produced electrolytic oxygen 35 is fed directly for use in the partial oxidation gasifiers 26 and 7.

As discussed, the electrical power required for electrolysis and for other process use and steam requirements for process use are produced utilizing the cleaned gasifier syngas 24 in conjunction with gas turbines and steam turbines. Any surplus hydrogen addition upgrader residuals 19 over those required for water quench hydrogen production 26 are used as supplementary fuel for the pyrolyzer gasifiers 7. Alternatively, all hydrogen addition upgrader residuals 19 may be used as supplementary fuel for the pyrolyzer gasifiers 7 and coal used as feedstock for water quench hydrogen production 26. In still another alternative the hydrogen required may be produced by water electrolysis by increasing the volume of syngas produced by pyrolyzer gasifiers 7 and hence electric power by gas turbine combined cycle for electrolysis with the increased co-produced electrolytic oxygen being beneficially used in the energy producing gasifiers.

In the preferred process, a blended synthetic light crude oil product is constituted by blending the light hydrogenated and hydrocracked product 18 of hydrogen addition upgrading and light ends 16 from distillation of a heavy oil raw material 2.

LOW LEVEL HYDROGEN ADDITION UPGRADING WITH SUPPLEMENTAL COKING OPERATION

Alternatively to the preferred process described above, where the percentage of coal volatile and crushed coal in the mixed feedstock to the hydrogen addition upgrader 17 is in the lower range of 40 to 70% of the total feedstock, less double-bonded benzene is present and its synergistic effect on upgrading is accordingly less. This will be determined in part by the heavy oil available as feedstock and also where a product with a higher napthenic and paraffinic content is required. In such a case, a less severe hydrogen addition upgrading step 17 may be desired in conjunction with supplemental coking of the residual 19 from the hydrogen addition upgrader 17 to thermally crack the residual and produce a further lighter oil product 31 as a constituent in the final blended product 20.

Figure 6:
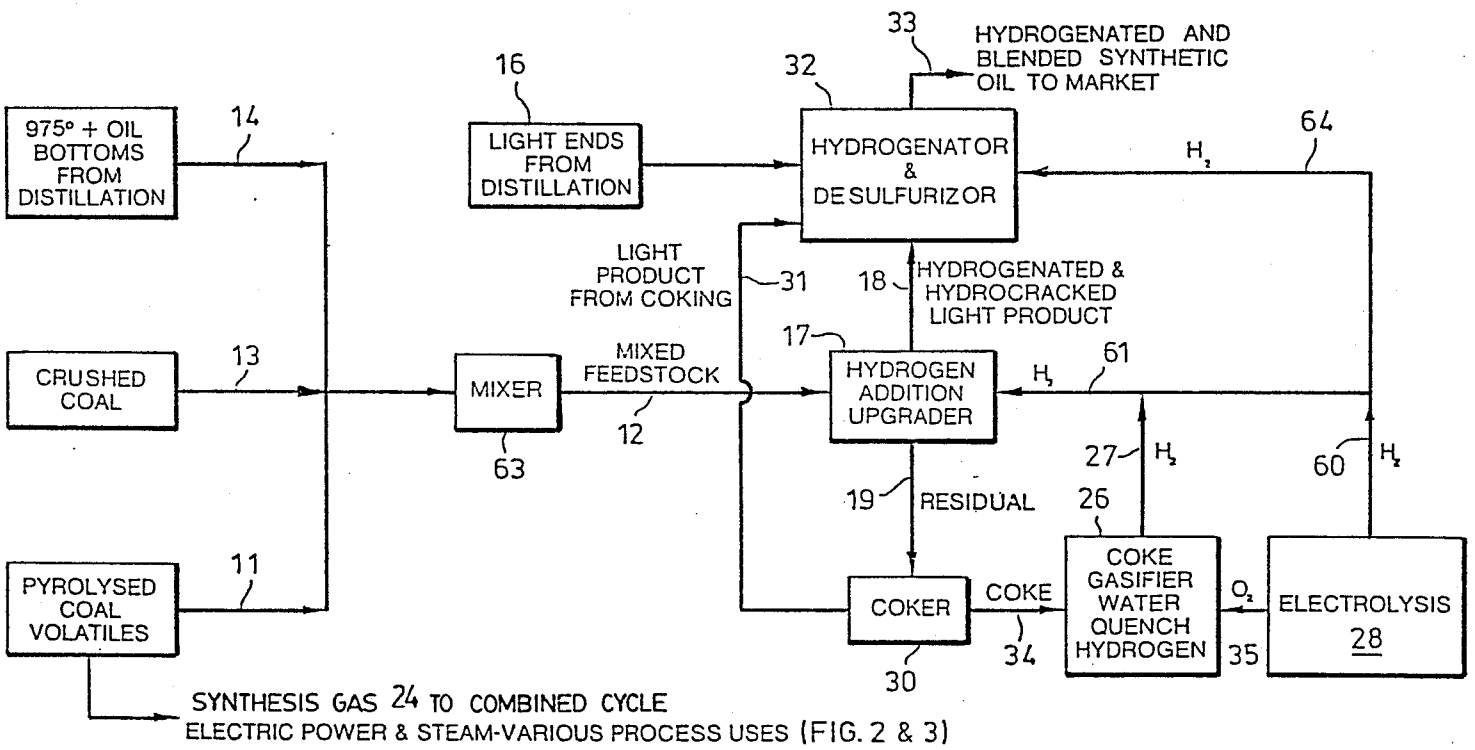
FIG. 6 is a simplified schematic flow diagram illustrating alternative upgrading processing steps in which both hydrogen addition upgrading and residual coking are used in upgrading the feedstock to produce a blended light synthetic crude oil product.

This alternative is illustrated in FIG. 6. The same three component mixed feedstock 12 is fed to the hydrogen addition upgrader 17. The upgrader 17 will be operated with catalyst, hydrogen and operating conditions so as to result in a lower level of conversion of the feedstock by hydrogenation and hydrocracking and accordingly produce less light product 18 from the upgrader 17. This will leave an additional amount of residual 19 which is fed to a coker 30 and hydrocracked to produce further light product 31. Conventional coking processes would be utilized to achieve this thermal cracking and are deemed to be within the scope of one skilled in the art. The light coker product 31 forms one constituent of what will be a three part blended product 33, the other two parts being the light product 18 produced by the upgrader 17 and the light end 16 from the upgrading, for example distillation, of a raw heavy oil feedstock. This three part blended synthetic oil 33 will preferably be subjected to a final process step of hydrogenation and desulphurization 32. To provide for maximum hydrogenation and desulphurization efficiency, hydrogen for this purpose is preferably supplied from the electrolytic hydrogen produced by electrolysis 28. Electrolytic hydrogen is a higher purity hydrogen than hydrogen produced by the gasification and water quenching step 26 and this higher purity hydrogen helps ensure a high product quality in the final blended product 33 while at the same time providing significant improvement in hydrogen use efficiency over hydrogen produced by other means in the process.

In this alternative upgrading and blending process, any preliminary hydrogenation of the mixed feedstock 12 may preferably be eliminated as well as any desulphurization of the heavy oil constituent 14 to the upgrader feedstock 12.

In this alternative, the residual coke 34 from the coker 30 constitutes the feed to the gasifier 26 with hydrogen 27 produced by water quenching the gasifier gases as described in the preferred embodiment above. Electrolysis 28 is utilized as previously.

The catalyst for use in the hydrogen addition upgrader 17 will again vary according to the composition of the feedstock mix and will also take into account the lower rate of conversion and severity of operation of the upgrader 17. The choice of a catalyst is within the competence of one skilled in the art and, as indicated above, catalysts such as cobalt molybdate provide a base from which to attain optimum catalytic effect.

Again, in this alternate processing, the production of hydrogen for initial upgrading 17 and final hydrogenation and hydrocracking 32 is closely integrated with the upgrading steps. The required hydrogen is produced both through water quenching of gasifier syngas 26 and by electrolysis 28. Preferably the gasifier—water quenched system 26 is the primary source of hydrogen with electrolysis producing what remaining hydrogen is required and producing the hydrogen required for the final hydrogenation and hydrocracking step 32.

As indicated briefly earlier, as to whether high severity, high conversion hydrogen addition reactor operations, without an additional coking step, are employed or whether a lower severity and lower conversion hydrogen addition reactor operation is used, with the addition of a coking step, will be dependent to a great extent on the volatile content of the coal raw material feedstock 1 used and the proportion of coal used in the total mixed feedstock 12. A high content of volatiles in the raw material coal 1 coupled with the use of a substantial proportion of coal volatile 11 and crushed coal 13 in the mixed feedstock 12 (in the upper end of a 40 to 70% coal composition) will render high conversion hydrogen addition upgrading beneficial, whereas a low coal volatile content and a proportion of coal at the lower end of 40 to 70% range of the total mixed feedstock 12 will increase the benefits of utilizing the supplemental coking step.

SUMMARY

The invented process is directed toward producing light synthetic crudes comparable to the light nature crudes to which today's world refinery capacity is geared. By the use of the two basic constituents, coal and heavy oil (bitumens or kerogens), the described process is adapted to produce finished synthetic crude oil products within the range of light crudes that present refinery capacity is based upon and to do so by varying the two basic raw material constituents with respect to the type or types of coal or heavy oil used or, more importantly, by varying the proportion of the two basic feeds in the total mixed feed stock.

Most bituminous or sub-bituminous or anthracite coals may be used, together with mixtures of these. 975° F. plus heavy oils as refinery residuals, and the "bottoms" distilled fractions of heavy viscous oils, tar sand bitumens or oil shale kerogens or mixtures of these may be used as well. Provided the proportion of coal to the total amount of mixed feed stock is no less than preferably 30% of the total, the described process system can be adapted to function as described with appropriate alterations to operating conditions to adjust the level of coal volatile produced by pyrolysis, the production of hydrogen desired for hydrogen addition upgrading and the severity or rate of conversion at which hydrogen addition upgrading and hydrocracking takes place as controlled by residence time, temperature and pressures.

Figure 7:
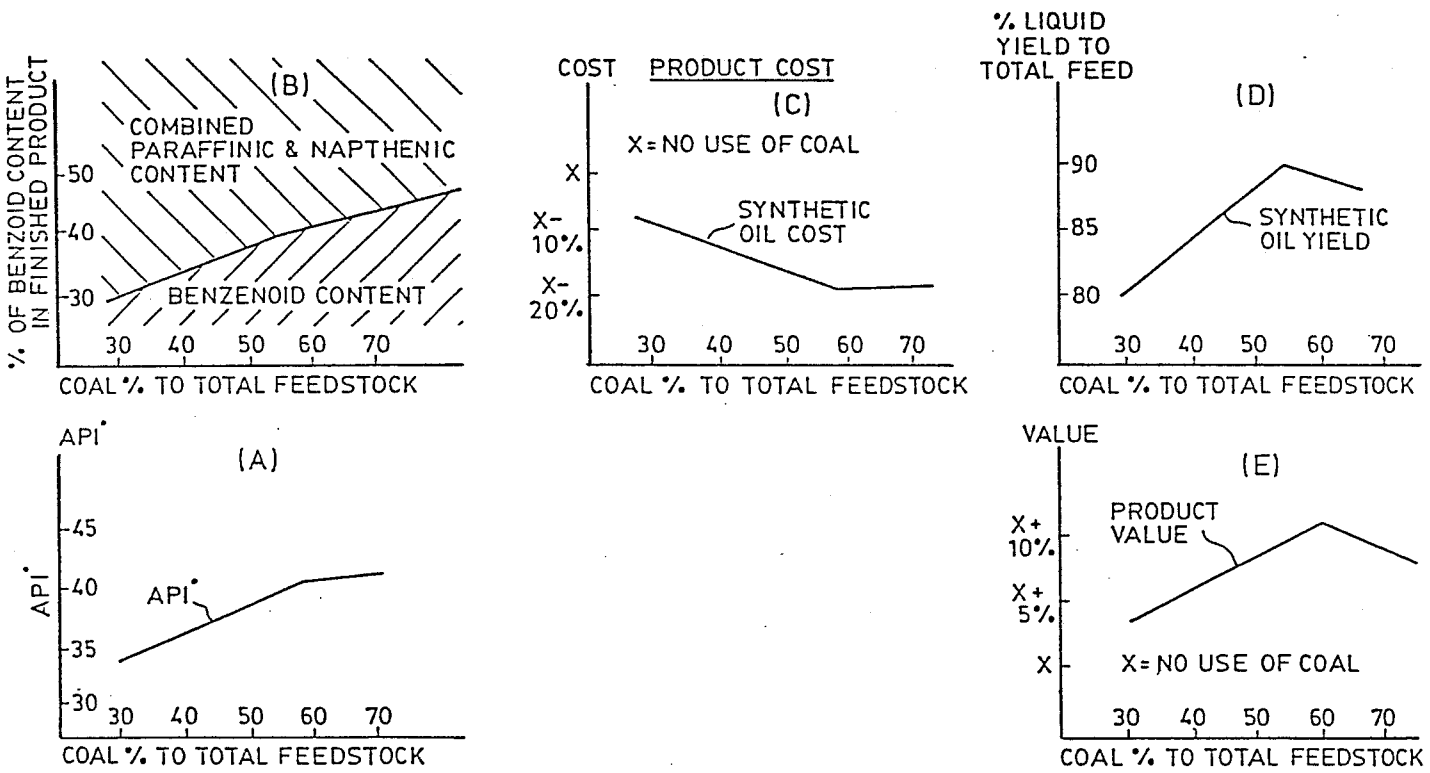
FIG. 7 contains a series of graphs to serve as guidance only in illustrating the nature of the indicated contribution to the process and final product of the coal components in the three part feedstock.

As discussed, the preferred proportion of coal in the total mixed feedstock 12 can range from a minimum of 30% to 60 to 70%. With coal constituents comprising in the range of 60% of the total mixed feedstock 12, the production of a synthetic crude oil with an API of 40° or higher is possible. FIG. 7 contains graphs which have been included as a guide to illustrate the nature of potential process results.

Illustration A in FIG. 7 demonstrates a simple approximation of the rate of increase in the API value of the finished product that has been indicated by increasing the proportion of coal constituent in the mixed feedstock 12.

Illustration B of FIG. 7 shows a simple approximation that the rate of increase in benzenoid material in the light synthetic crude product (21 or 33) which is indicated by an increase in the proportion of coal in the mixed feedstock 12. The increased API and benzenoid content are indicated as the result of increasing the coal constituent in the mixed feedstock 12 in the form of both coal volatiles and crushed coal, and as the result of exploiting the contribution to hydrocracking efficiency presented by the reactive hydrogen double-bonded benzene ring present in the coal constituent and its propensity in the hydrogen addition reactor to assist in the hydrocracking of the longer chain molecules contained in the non-volatile coal components and the heavy oil constituent.

It is also indicated that the unit cost of production of the final light oil product decreases with an increase in a proportion of coal constituent in the mixed feedstock 12. This is generally indicated in illustration C of FIG. 7. Low cost hydrogen, energy efficiency, high hydrocracking conversion, the consumption of most waste residuals including coal char for energy production also contribute to reduced product cost. However, one single large factor in this reduced cost is derived from the use of coal in that coal may normally be supplied f.o.b. the coal mine at approximately one-sixth the cost of heavy oils, bitumens or kerogens and generally less than three times as much coal by weight is required to produce the same unit product yield as heavy oils. Illustration D of FIG. 7 generally indicates a volume increase in yield available through the use of greater proportions of coal in the mixed feedstock 12. Illustration E of FIG. 7 generally illustrates an indicated increase of product value of nearly 10% between the 33° API synthetic oil product resulting from the use of coal constituents as 30% of the feedstock and the 40° or higher API product resulting from increasing the coal constituent to 60% of the total feedstock.

The overall process described is a closely integrated one with a conversion of a coal volatile, coal and heavy oil constituted feedstock to a light synthetic crude oil. A high yield low cost production of synthetic crude oil can be achieved which is closely comparative with the best conventional natural crude oils and substantially more competitive than synthetic oils produced by either of the basic feedstocks when processed separately. At the same time, the disclosed process is essentially self-sufficient once initiated in that the two basic feedstock raw materials, coal and heavy liquid oils, comprise the source of all the synthetic light oil produced and all the primary energy required for the processing, the latter being produced from low value residual hydrocarbons produced in the process thereby promoting a high thermal efficiency.

The integration of the described process allows it to be adapted to the characteristics of the particular coal or heavy oil feedstock available or being used. If more energy is required for pyrolyzation, more upgrader residual 19 can be fed to gasifiers 7, and the required production of hydrogen is then adjusted between the gasifier water quenched step 26 and electrolysis 28. On the other hand, more residual can be fed to the gasifier—water quenched system so as to increase the amount of hydrogen produced for upgrading if it is more efficient to concentrate on the degree of conversion of the hydrogen addition feedstock 12. Also, whole, unpyrolyzed coal may be used as a "balancing" fuel for the process, i.e. as a supplement to coal char and oil or coke residuals used as gasifier fuel. In the case of the integration of the units in the process they can collectively be set at a number of related and process cooperative levels of operation.

It will be appreciated from the foregoing that the invention can take other forms, and the process steps can take modified or varied forms consistent with the scope of the process invention described above, to achieve the production of a light synthetic crude oil from a coal based feedstock.

For example, conventional boilers could be utilized in combination with the gasifiers to produce part of the processed thermal energy required, the boilers using coal or some of the heavy residual oils as fuel.

Heat recovery and energy production from waste heat, within the scope of the invention that has been described, can be accomplished in many alternative ways, for example, to reduce the cost of waste heat boilers and heat exchanger devices. For example, FIG. 2 illustrates cooling of the syngas 8 in a heat moderation section 53 of pyrolyzer 5 with downstream recovery of waste heat from cooled syngas 22 to produce steam and electricity for process use. Other means of cooling the syngas 8 can be used to more directly convert the heat so extracted to forms of energy, such as steam, ready for process use and thereby reduce the degree to which heat exchangers and waste heat boilers are used.

Figure 4:
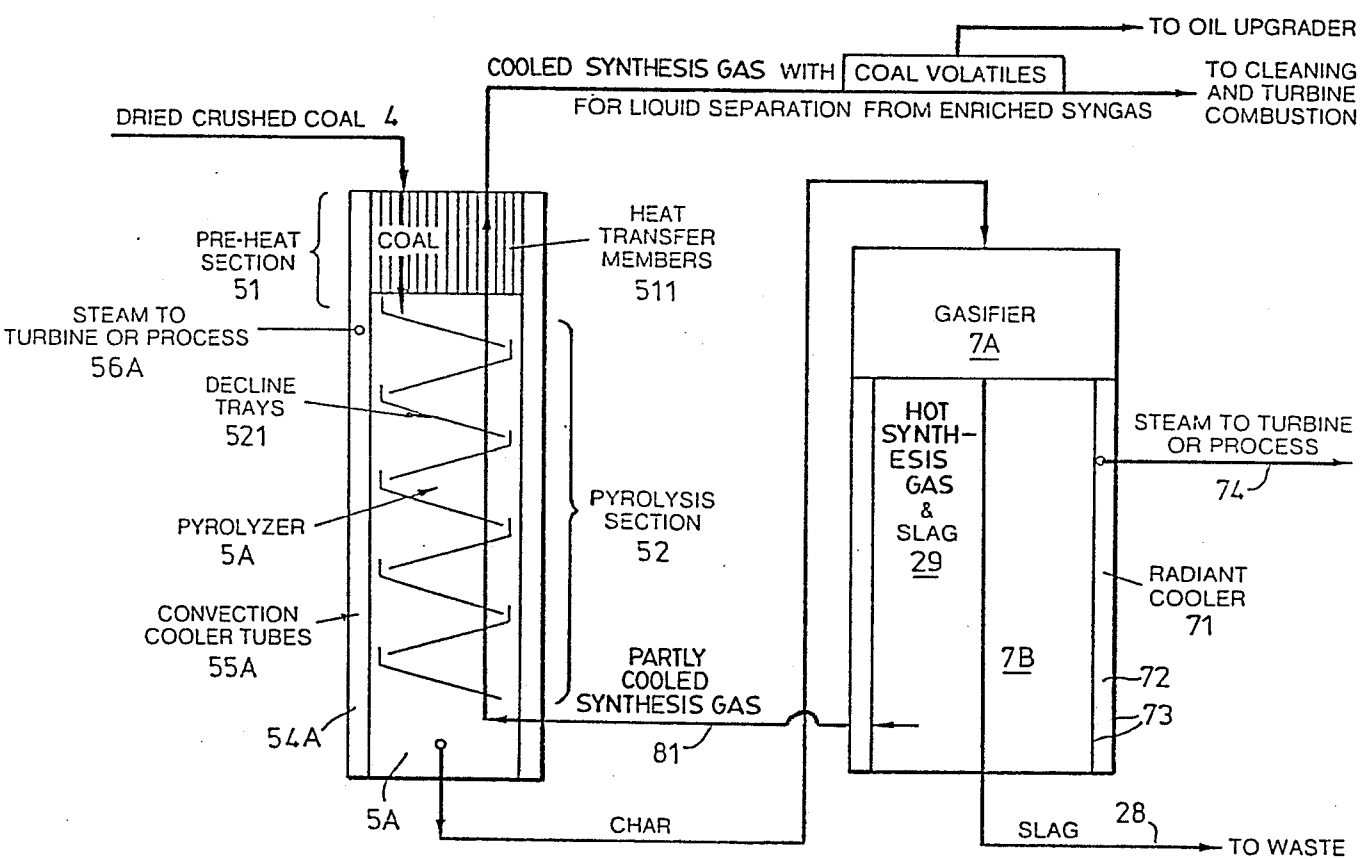
FIG. 4 is a simplified schematic flow diagram illustrating an alternative pyrolysis-gasification operation to that of FIG. 2.

FIG. 4 illustrates one such alternative arrangement involving varied gasifier and pyrolyzer operations. In this arrangement the pyrolyzer 5A does not have a heat moderating section 53. The gasifier 7A is equipped in a downstream section 7B with a circumferential radiant cooler 71 through which heat is recovered from the hot syngas 8 and slag 29. For example, the radiant cooler 71 illustrated in FIG. 4 compresses an outer cavity 72 defined by double walls 73 and water can be passed through the cavity 72 to produce steam 74 for process use together with waste heat boiler steam 41 or for feed to the steam turbine generator 42, or a combination of these. The effect of such radiant cooling is to begin cooling the syngas 8. Partly cooled syngas 8 can be taken from the downstream cooling section 7B when it reaches a temperature in the area of 1200° F. to 1700° F., preferably around 1200° F., and fed to the bottom of the pyrolysis section 52 of the pyrolyzer 5A. The slag 28 presents a further source for further heat energy.

The pyrolyzer 5A as illustrated in FIG. 4 comprises only two main sections, the preheat section 51 and pyrolysis section 52 as described with references to FIG. 2. In addition, it contains a circumferential conventional cooler systems 54A containing conventional cooler tubes 55A through which water is passed to produce steam 56A that can similarly be used as additional process steam or as steam turbine 42 feed, or a combination of these.

The availability of low cost methane could make the production of hydrogen by reforming methane a competing alternative to gasification of waste residuals from hydrogen addition (or coking) upgrading with or without production of part of the hydrogen requirement by electrolysis. However, as a highly valuable hydrocarbon, methanes used in a large scale synthetic oil process would adversely affect the favourable economics of the disclosed invention if, as anticipated, methane prices increase substantially as conventional supplies of oil become scarce.

With hydrogen being produced by electrolysis in the described process, the production of low cost by-product heavy water is also an alternative. A water partially enriched in $D_2O$ by dual temperature $H_2S$ exchange methods would constitute the water feed for electrolysis production of hydrogen and oxygen as primary products and heavy water as a by-product. Where deuterium oxide ($D_2O$) is produced from natural water by a first stage of dual temperature $H_2S$ exchange to a level of partial enrichment, at the site of the process described by the invention, the heat in large volumes of deuterium depleted hot water may be recovered by air heat exchange, and the heated air used to dry and partially preheat incoming coal feeds to the process.

Indeed, where maximum quantities of heavy water are of interest, all the hydrogen required could be produced by the electrolysis of water. In such a case, the co-produced electrolytic oxygen could be utilized to enrich the air feed to gasifiers 7 with all of the hydrogen addition upgrader residuals being used as additional feed to the gasifier 7. The oxygen enrichment and additional residual feed to the gasifier 7 would increase the BTU value of the gasifier syngas providing some reduction in size of the energy producing system. Any additional oxygen required for gasifiers may be produced by air separation using combined cycle power produced from coal and lower value residuals. Surplus low cost electric power may also be produced for sale by increasing the coal pyrolyzergasification capacity, or as described below, the system could be dedicated to electric power as a primary product.

Further, the co-processing of coal and heavy oil liquid raw material would also permit supplementing the coal constituent of the feedstock with some crushed oil shale. A potentially higher yield of retorted volatiles is indicated from a mixed coal and oil shale feed. The combustion of residual shale following retorting of most of the kerogens contained in the oil shale by pyrolysis, together with the coal char and hydrogen addition upgrading residuals, may be carried out advantageously. This alternative is potentially attractive when coal and oil shale may be brought together economically and heavy oil liquids are not economically available. In such a case, part of the oil shale raw material could be retorted directly to produce heavy liquid kerogens and part of the oil shale raw material fed to the pyrolyzer in a mixture with crushed coal, preferably in the range of 65 percent to 35 percent coal to oil shale. The direct retorting of the oil shale could be carried out in pyrolyzers of similar design to those described above with the heavy liquid kerogens produced then being fractionated by distillation to produce a light end for a final blend, and heavy bottoms as one of the three components of the mixed feedstock 12 for hydrogen addition upgrading, the other two coal based constituents being the light liquid volatiles recovered by the pyrolysis of the coal—oil shale mix and crushed whole coal. The product characteristics of co-producing coal oil shale raw material would tend to be disposed towards relatively high content of benzenoid and paraffinic constituents. Nonetheless, similar economic and chemical synergies would be gained.

It will be appreciated also that the overall system is not dependent upon pyrolysis of coal by the particular gasifier hot syngas direct contact system described above in unit 5. Any efficient, lower cost pyrolysis process system which uses the sensible heat of the syngas as the heat source for pyrolysis while recovering the gasifier syngas and non-condensible coal volatile gases produced by pyrolysis as the fuel for gas turbine combustion in a combined cycle for electric power and process steam would be consistent with the process system described and would be preferred if advantageous in the overall.

A further form which the invention may take relates to the fact that a significant proportion of the coal volatiles produced by pyrolysis 5 will consist of non-condensible gases. These coal volatile gases will have a significantly higher BTU value than gasification syngas (i.e. 300 BTU to 600 BTU versus 100 BTU to 200 BTU) and will therefore enrich the combined syngas BTU value proceeding to gas turbine combined cycle energy production. Such BTU enrichment will help to increase the efficiency of the combined cycle system and reduce the size of equipment. This may be of special value where it is desirable to produce surplus low cost electric power for external sale, as a process by-product by producing more power by increasing the coal pyrolyzer—char gasifier—combined cycle power system capacity. It will be appreciated that the production of surplus electric power for external sale may be especially attractive where the synthetic oil plant described is sited at the source of abundant coal supply close to both markets for the oil product and electric power.

It will be further appreciated from earlier discussion that the invented process may be balanced to produce base load electric power for a conjoined electric power system, or a part of such system, which uses, or may use, coal as its energy source, by increasing the capacity of the pyrolyzer gasifier combined cycle gas/turbine sub-system producing electric power, substantially beyond the capacity of the sub-systems for synthetic oil production, in effect making synthetic oil the by-product of electric power production. Again, whole unpyrolyzed coal may be used as a "balancing" fuel. Alternatively or supplementally, such a system could contain additional gasifiers fueled by whole unpyrolyzed coal, this additional syngas being fed directly to the combined cycle gas/turbine sub-system.

In this overall system arrangement the synthetic oil component would enjoy maximum availability of reactive double bonded benzene ring molecules in the hydrogen addition upgrader. The quantity of pyrolyzed coal volatiles produced could be limited to that desired as feedstock for synthetic oil by-product production or be such as to provide a surplus for sale as a by-product in the form of liquid coal volatiles or after conversion to a petrochemical, together with increased quantities of elemental sulphur.

The invented process, when used to produce steady state, base load electric power for the process itself and for a utility electric power grid in large quantities will enjoy the benefits of high usage of coal char and other coke residuals with $H_2S$ emissions tightly controlled. Also, the electrolytic hydrogen and oxygen required for the process may be produced economically from off-peak power because electrolysis apparatus, being static or non-mechanical and having a long, low maintenance life, may be "turned down" during peak utility electric power daily demand with minimum penalty.

I claim:

1. A process for the production of a synthetic crude oil by co-processing non-coal heavy oil and coal comprising the steps of:

(1) producing coal volatiles and a hydrocarbon residual by thermal pyrolysis of a first allotment of crushed coal using temperatures that avoid thermal degradation of the coal volatiles;

(2) gasifying said hydrocarbon residual to produce a synthesis gas in first gasifiers moderated by one or more of the group consisting of air, oxygen or oxygen enriched air;

(3) utilizing the sensible heat in said synthesis gas to effect the said thermal pyrolysis of said crushed coal and produce said coal volatilies;

(4) condensing the condensible coal volatiles from the synthesis gas and mixing the coal volatiles with a second allotment of crushed coal and a non-coal heavy oil to produce an upgrader feedstock;

(5) upgrading said feedstock by hydrogen addition comprising hydrogenation and catalytic hydrocracking to produce an upgrader lighter crude oil, an upgrading residual, and an upgrading off gas.

2. A process as claimed in claim 1 comprising the further step of:

(6) mixing said upgraded lighter crude oil with light ends of heavy oil to produce a blended synthetic light crude oil product having benzenoid, paraffinic, napthenic and sulphur components in proportions similar to that of natural light crudes.

3. A process as claimed in claim 2 wherein said light ends are distilled ends of heavy oil and the non-coal heavy oil constituent of said upgrader feedstock is the residual bottoms produced by distillation of non-coal heavy oil.

4. A process as claimed in claim 1 wherein crushed oil shale is added to said first allotment of crushed coal prior to pyrolysis.

5. A process as claimed in claim 1 wherein hot multisided ceramic shapes are added to said first allotment, of crushed coal prior to pyrolysis.

6. A process as claimed in claim 1 wherein the condensed coal volatiles and crushed coal comprise 30% to 70% (by weight) of the upgrading feedstock.

7. A process as claimed in claim 1 which comprises the further step of:

(6) utilizing said coal volatile stripped synthesis gas to produce steam and electrical energy for use in the process.

8. A process as claimed in claim 1 which comprises the further steps of:

(6) desulphurizing said coal volatile stripped synthesis gas and recovering elemental sulphur therefrom; and, (7) utilizing said coal volatile stripped and sulphur stripped synthesis gas to produce steam and electrical energy for use in the process.

9. A process as claimed in claim 7 in which said upgrading further comprises the recovery of elemental sulphur.

10. A process as claimed in claim 7 wherein said upgrading further comprises the recovery of elemental sulphur and said process further comprising the steps of:

(7) electrolyzing water to produce hydrogen and oxygen;

(8) utilizing said hydrogen for said hydrogen upgrading; and (9) utilizing said oxygen in said first gasifiers.

11. A process as claimed in claim 9 or 10 wherein said process comprises the further step of recovering sulphur from said upgrading off gas.

12. A process as claimed in claim 10 wherein said stripped synthesis gas is utilized to produce electrical power for said electrolysis and steam for thermal energy for gasification and upgrading.

13. A process as claimed in claim 1 which further comprises an initial step of heating the allotments of crushed coal to dry said coal to a point of adsorbed moisture content of 5 to 15% and crushing the dried coal to produce a coarsely crushed coal for said first allotment of crushed coal and a finely crushed coal for said second allotment of crushed coal.

14. A process as claimed in claim 13 wherein said first allotment of crushed coal is further heated to a temperature in the range of 300° to 400° F. prior to pyrolysis thereof to avoid during pyrolysis premature condensation of coal volatiles carried by the synthesis gas on initial contact of the crushed coal with the synthesis gas, and said coal in the pyrolysis step is heated to a temperature in the range of 800° to 850° F. to volatize said coal volatiles.

15. A process as claimed in claim 13 wherein said second allotment of crushed coal is further heated to a temperature in the range of 200° to 300° F. prior to feedstock mixing.

16. A process as claimed in claim 14 in which the synthesis gas of said first gasifiers is at a temperature in the range of 2,000° to 2,400° F. when fed to heat said first allotment of crushed coal in the pyrolysis step.

17. A process as claimed in claim 14 in which the synthesis gas of said first gasifiers is at a temperature in the range of 1200° F. to 1700° F. prior to passing through the said first allotment of crushed coal in the pyrolysis step.

18. A process as claimed in claim 9 which comprises the additional steps of:

(8) gasifying said upgrading residual in second gasifiers moderated with oxygen to produce a slag waste residual and hot gases containing hydrogen;

(9) water quenching said hot gases to recover the hydrogen therefrom for use in said hydrogen addition upgrading.

19. A process as claimed in 9 which comprises the additional steps of:

(8) gasifying a first portion of said upgrading residual in second gasifiers moderated with oxygen to produce a slag waste residual and hot gases containing hydrogen;

(9) water quenching said hot gases to recover the hydrogen therefrom for use in said hydrogen addition upgrading; and,

(10) utilizing a second portion of said upgrading residual as feed to said first gasifiers for synthesis gas production.

20. A process as claimed in claim 10 which comprises the additional steps of:

(10) gasifying a first portion of said upgrading residual in second gasifiers moderated with oxygen to produce a slag waste residual and hot gases containing hydrogen;

(11) water quenching said hot gases to recover the hydrogen therefrom for use in said hydrogen addition upgrading; and,

(12) utilizing a second portion of said upgrading residual as feed to said first gasifiers for synthesis gas production;

in which said electrolysis oxygen is utilized in said first and second gasifiers as the combustion moderator and said electrolysis hydrogen is produced to supplement hydrogen recovered in step (11) to provide the hydrogen feed for upgrading.

21. A process as claimed in claim 7 further comprising the steps of:

(7) electrolyzing water to produce hydrogen and oxygen;

(8) gasifying said upgrading residual in second gasifiers moderated with oxygen to produce a slag waste residual and hot gases containing hydrogen;

(9) water quenching said hot gases to recover the hydrogen therefrom;

(10) utilizing the electrolytic hydrogen and water quenching recovered hydrogen for said hydrogen upgrading; and

(11) utilizing said oxygen in said energy gasifiers and hydrogen producing gasifiers as the combustion moderator.

22. A process as claimed in claim 3 wherein the process comprises the additional step of upgrading a non-coal heavy oil feed by distillation, to produce said light ends of non-coal heavy oil for blending, and said heavy oil residual for the non-coal heavy oil constituent of said upgrader feedstock.

23. A process as claimed in claim 1 wherein said upgrading step comprises low conversion of the upgrader feedstock by said hydrogen addition upgrading thereby producing lesser upgrader lighter crude oil and more heavy upgrading residual and comprises the additional step of:

(6) hydrocracking the heavy upgrading residual to produce a second light oil fraction for combination with said upgrader lighter crude oil and a coke residual.

24. A process as claimed in claim 23 wherein said hydrocracked light oil fraction and said upgrader light crude oil are blended with distilled light ends of heavy oil to produce the blended synthetic light crude oil product.

25. A process as claimed in claim 28 wherein the process comprises the additional step of upgrading a non-coal heavy oil feed by distillation to produce said light ends of non-coal heavy oil for blending and non-coal heavy oil residual bottoms for use as the non-coal heavy oil constituent of said upgrading feedstock.

26. A process as claimed in claim 23 comprising the additional steps of:

(8) electrolyzing water to produce hydrogen and oxygen;
(9) gasifying said coke residual in second gasifiers moderated with oxygen to produce hot gases containing hydrogen;
(10) water quenching said hot gases to recover hydrogen therefrom;
(11) utilizing the electrolytic hydrogen and water quench-recovered hydrogen for said low conversion hydrogen addition upgrading;
(12) utilizing said oxygen in said first gasifiers and second coke fueled gasifiers; and
(13) utilizing said coal volatile stripped synthesis gas to produce steam and electrical energy for use in the process.

27. A process as claimed in claim 12 or 26 in which the utilization of coal volatile stripped synthesis gas to produce process energy comprises a combined cycle of the following steps:
(i) desulphurizing said synthesis gas to recover elemental sulphur therefrom;
(ii) utilizing said coal volatile stripped and sulphur stripped synthesis gas to drive gas turbines to produce electricity for process use and a hot exhaust gas;
(iii) passing said hot exhaust gas through a waste heat recovery boiler to produce high temperature high pressure steam;
(iv) utilizing a first portion of said steam to drive steam turbines and produce further electricity for process uses and utilizing a second portion of said steam for heat energy in said process.

28. A process as claimed in claim 12 or 26 in which the utilization of coal volatile stripped synthesis gas to produce process energy comprises a combined cycle of the following steps:
(i) desulphurizing said synthesis gas to recover elemental sulphur therefrom;
(ii) utilizing said coal volatile stripped and sulphur stripped synthesis gas to drive gas turbines to produce electricity for process use and a hot exhaust gas;
(iii) passing said hot exhaust gas through a waste heat recovery boiler to produce high temperature high pressure steam;
(iv) utilizing said high temperature steam to drive a back pressure steam turbine to produce further electricity for process use, and exhausted low pressure steam for heat energy use in said process.

29. A process as claimed in claim 23, 24, or 26 comprising the additional steps of:
(i) hydrogenating the blended synthetic light crude product,
(ii) utilizing a portion of said electrolytic hydrogen for said hydrogenation.

30. A process as claimed in claim 1, 2 or 23 in which hydrogenation is initiated during mixing of the upgrader feedstock components by limited hydrogen addition at that stage.

31. A process as claimed in claim 1 wherein said crushed coal and said synthesis gas travel countercurrently in the pyrolytic production of said coal volatiles, the vaporized coal volatiles mixing with and being carried by the syngas.

32. A process as claimed in claim 31 comprising the additional step of preheating the first allotment of said crushed coal to avoid during pyrolysis premature condensation of coal volatiles carried by the synthesis gas on initial contact of the crushed coal with the synthesis gas.

33. A process as claimed in claim 1, 7 or 12 wherein the production capacities of the pyrolysis and gasification apparatus are increased beyond the needs of said process to produce electric power or heavy water as saleable by-products of said process by increasing the residual feed to said first gasifiers and utilizing the BTU enrichment provided to the coal volatile stripped synthesis gas by the non-condensible coal volatiles it continues to carry.

34. A process as claimed in claim 1 which comprises the further steps of:
(6) extracting heat from said pyrolysis step to produce steam for use in the process;
(7) extracting heat from said synthesis gas prior to its use in pyrolyzing said crushed coal to provide a partially cooled synthesis gas;
(8) utilizing said extracted heat and said coal volatile stripped synthesis gas to produce energy for use in the process.

35. A process as claimed in claim 34 wherein said crushed coal and said synthesis gas travel countercurrently in the pyrolytic production of said coal volatiles, the vaporized coal volatiles mixing with and being carried by the synthesis gas.

36. A process as claimed claim 1 which comprises the further step of supplementing the hydrocarbon residual feed to said first gasifiers with whole unpyrolyzed coal.

37. A process as claimed in claim 1 or claim 36 which comprises the further steps of
(7) gasifying whole coal in supplemental gasifiers to produce additional synthesis gas; and,
(8) utilizing the additional synthesis gas produced in step (7) to produce electric power.

* * * * *